US011432648B1

(12) United States Patent
Black et al.

(10) Patent No.: US 11,432,648 B1
(45) Date of Patent: Sep. 6, 2022

(54) WALL BRACKET

(71) Applicant: STRONGHOLD BRACKETS, West Valley City, UT (US)

(72) Inventors: Steve Black, Herriman, UT (US); Robert Light, West Valley City, UT (US); Kevin Black, Santaquin, UT (US)

(73) Assignee: STRONGHOLD BRACKETS, West Valley City, UT (US)

( * ) Notice: Subject to any disclaimer, the term of this patent is extended or adjusted under 35 U.S.C. 154(b) by 95 days.

(21) Appl. No.: 16/523,175

(22) Filed: Jul. 26, 2019

Related U.S. Application Data

(60) Provisional application No. 62/711,595, filed on Jul. 29, 2018.

(51) Int. Cl.
*A47B 96/02* (2006.01)
*A47B 96/06* (2006.01)

(52) U.S. Cl.
CPC ..... *A47B 96/066* (2013.01); *A47B 96/028* (2013.01)

(58) Field of Classification Search
USPC ..... 248/235, 239, 247, 248, 250; 211/90.01, 211/90.02, 103, 193
See application file for complete search history.

(56) References Cited

U.S. PATENT DOCUMENTS

| | | | | | |
|---|---|---|---|---|---|
| 2,261,078 | A * | 10/1941 | Shockey | A47B 96/022 | 108/42 |
| 4,313,587 | A * | 2/1982 | Loeschen | A47B 57/56 | 248/217.2 |
| 6,098,552 | A * | 8/2000 | Gunderson | A47B 96/061 | 108/108 |
| 6,164,610 | A * | 12/2000 | Santiago | A47B 96/022 | 211/90.01 |
| 7,360,627 | B2 | 4/2008 | Scott | | |
| 8,087,521 | B2 * | 1/2012 | Schwartzkopf | A47F 5/101 | 211/94.01 |
| 8,695,816 | B2 * | 4/2014 | Troyner | A47B 96/1441 | 211/187 |
| 10,021,972 | B1 * | 7/2018 | Robinson | A47B 96/061 | |
| 10,294,679 | B2 | 5/2019 | Muth | | |
| 2018/0245356 | A1 * | 8/2018 | Muth | F16B 2/12 | |
| 2018/0289151 | A1 * | 10/2018 | Dahatonde | A47B 57/48 | |
| 2019/0059586 | A1 * | 2/2019 | Bowser | A47B 96/067 | |

* cited by examiner

*Primary Examiner* — Alfred J Wujciak
(74) *Attorney, Agent, or Firm* — Maschoff Brennan

(57) ABSTRACT

A support bracket may include a brace section and a protrusion. The brace section may include a base, a first arm, and a second arm. The base may define a first opening. The first arm may extend from the base in a first direction. The second arm may extend from the base in the first direction. The protrusion may extend from the base of the brace section in a second direction. The second direction may be opposite the first direction.

10 Claims, 7 Drawing Sheets

WALL BRACKET

CROSS-REFERENCE TO RELATED APPLICATIONS

This application claims the benefit of and priority to U.S. Provisional Application No. 62/711,595, filed Jul. 29, 2018, titled WALL BRACKET, which is incorporated herein by reference in its entirety.

BACKGROUND

A shelf may generally attach to a wall by way of brackets affixed to the wall. Shelves described as floating shelves may be designed to generally hide the brackets from an observer of the installed shelf. Thus, for example, a floating shelf may protrude from a wall without visible supports, thereby appearing, as the name suggests, to float on the wall.

SUMMARY

In some embodiments, a support bracket may include a brace section and a protrusion. The brace section may include a base, a first arm, and a second arm. The base may define a first opening. The first arm may extend from the base in a first direction. The second arm may extend from the base substantially in the first direction. The protrusion may extend from the base of the brace section in a second direction. The second direction may be substantially opposite to the first direction.

In some configurations, a distance between the first arm and the second arm of the brace may be approximately 1.5 inches.

Alternately or additionally, the first arm may define a second opening and the second arm may define a third opening. In some configurations, the second opening and the third opening may be circular. The second opening and the third opening may be substantially coaxially aligned.

In some configurations, the base may include a first rectangular plate, the first arm may include a second rectangular plate; and the second arm may include a third rectangular plate. The first arm may be located at a first edge of the base and the second arm may be located at a second edge of the base. The first edge and the second edge may be located at opposite ends of the base.

Alternately or additionally, the protrusion may include a hook.

In some embodiments, a method of installing an object on a wall may include positioning a bracket on a support member of the wall such that the support member is located within a channel of the bracket formed by a base of the bracket and two arms of the bracket extending from the base in a first direction. The bracket may be fastened to the support member, including extending a fastener through a hole defined by the base of the bracket and into the support member. The object may be positioned onto a protrusion of the bracket, where the bracket may extend from the base of the bracket in a second direction. The second direction may be opposite the first direction. The object may be secured to the bracket or to the wall.

Alternately or additionally, the method may include cutting a hole in a wallboard of the wall. In some configurations, the wallboard may be further installed to the support member such that the bracket is located within the hole of the wallboard. Alternately, the wallboard may be secured to the support member and the bracket may be positioned on the support member through the hole of the wallboard.

In some instances, the support member may include a metal stud having a hollow interior and the method may further include inserting a wood stud into the hollow interior of the metal stud such that the metal stud and the wood stud are located within the channel of the bracket. The bracket may be fastened to the support member by extending a second fastener through a second hole defined by one of the arms of the bracket.

Alternately or additionally, the object may include a shelf and securing the shelf to the bracket or the wall may include applying an adhesive to an interface between the object and the wall.

Optionally, the method may include securing a cleat to the wall. In some instances, securing the object to the wall may include attaching the object to the cleat.

In some embodiments, a shelf assembly may include a support bracket, a wall, and a shelf. The support bracket may include a brace section and a protrusion. The brace section may include a base defining a first opening, a first arm extending from the base in a first direction, and a second arm extending from the base substantially in the first direction. The protrusion may extend from the base in a second direction. The second direction may be opposite the first direction. The wall may include a support member and a wallboard attached to the support member. The support member may be located at least partially within a channel of the bracket, the channel formed by the base, the first arm, and the second arm of the bracket. The shelf may define a shelf opening. The protrusion of the support bracket may be located at least partially within the shelf opening.

The shelf assembly may further include a cleat positioned on the wallboard and located at least partially within the shelf opening. Alternately or additionally, the shelf assembly may further include an adhesive located between the shelf and the wallboard. In some configurations, the support member of the wall may include a metal stud including a hollow interior and a wood stud located within the hollow interior of the metal stud. The metal stud and the wood stud may both be located at least partially within the channel of the bracket.

DESCRIPTION

Floating shelves may rely upon brackets that are hidden within and/or behind a body of the shelf. Accordingly, for example, floating shelf brackets may act as cantilever supports for the shelf. The cantilever support configuration may be subjected to relatively higher stresses than alternate shelf support configurations. For instance, the nature of the cantilever support may subject the bracket and bracket fasteners to relatively high forces from the weight of the shelf and of objects placed on the shelf. Furthermore, struts that might act to mitigate the relatively high forces experienced by the cantilever support may hamper or eliminate the floating shelf aesthetic. As a result, conventional floating shelves may exhibit significant limitations in the amount and placement of weight the shelves may support. Conventional floating shelves may be more likely, relative to comparable non-floating shelves, to detach from a wall or otherwise fail when subjected to a particular loading. Conventional floating shelf brackets may generally be affixed to an outer surface of a wall by way of fasteners, such as screws, which may be designed to penetrate the surface of the wall and to mechanically anchor the brackets to the wall.

Some embodiments disclosed herein may include bracket configurations that may significantly increase an amount of weight that the brackets and associated fasteners may be subjected to before failing. In some embodiments, the disclosed brackets may be employed to secure other wall-mounted objects subjected to relatively high-weight loading or to loading placements that may generate relatively high stresses on an associated bracket. Additionally, the disclosed brackets may be hidden from view by the mounted objects. For instance, in some configurations, disclosed brackets may be employed to secure floating shelves; floating cabinets and/or counters, including floating vanities; taxidermy mounts, such as hunting trophy head mounts; floating steps, seats, and/or benches; wall-mounted toilets and/or sinks; floating fireplace mantels; floating desks, tables, entertainment centers, and/or bookcases; and the like or any combination thereof.

Figure 1A:
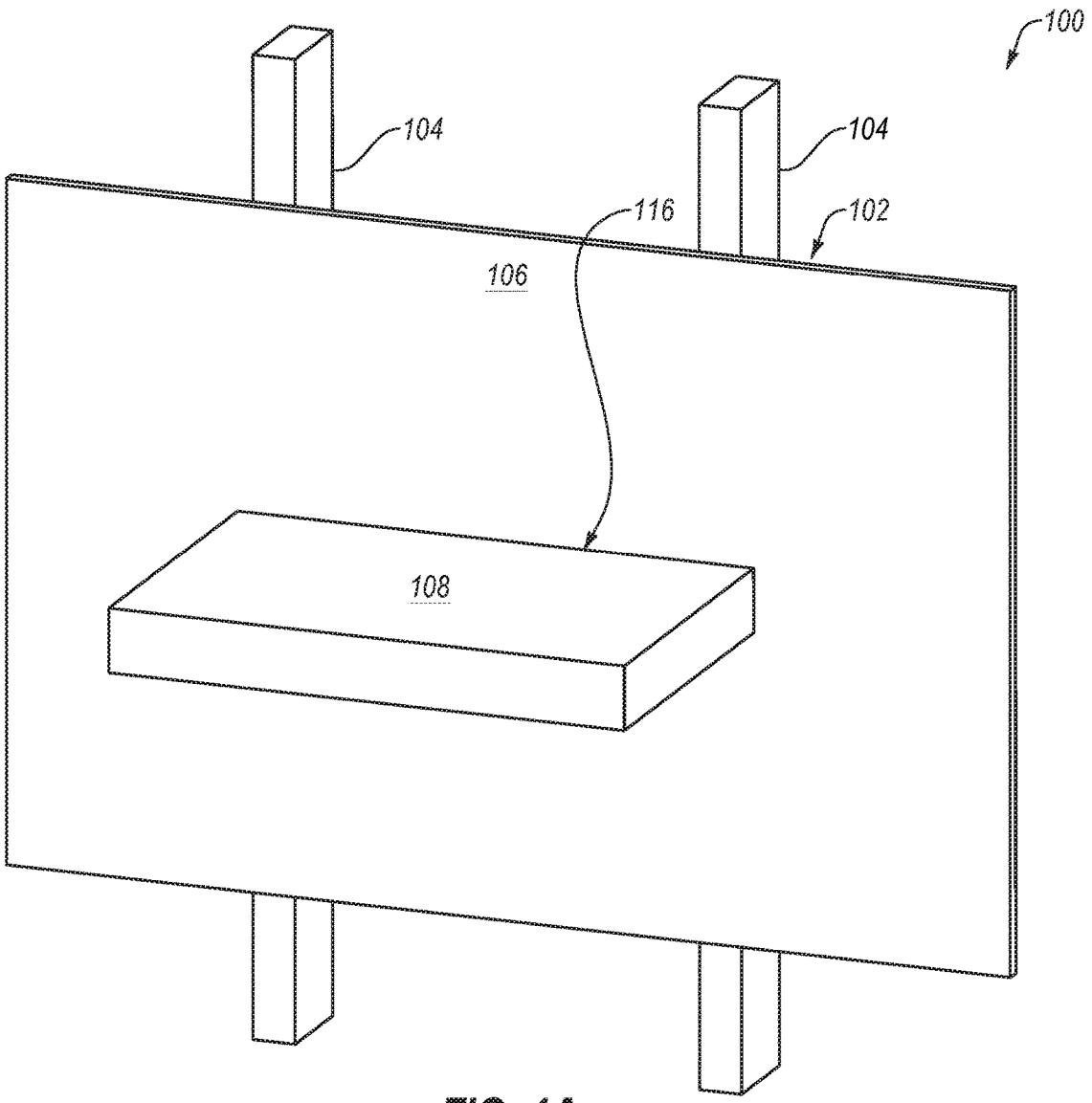
FIG. 1A illustrates a perspective view of an example environment in which some embodiments may be practiced.
Figure 1B:
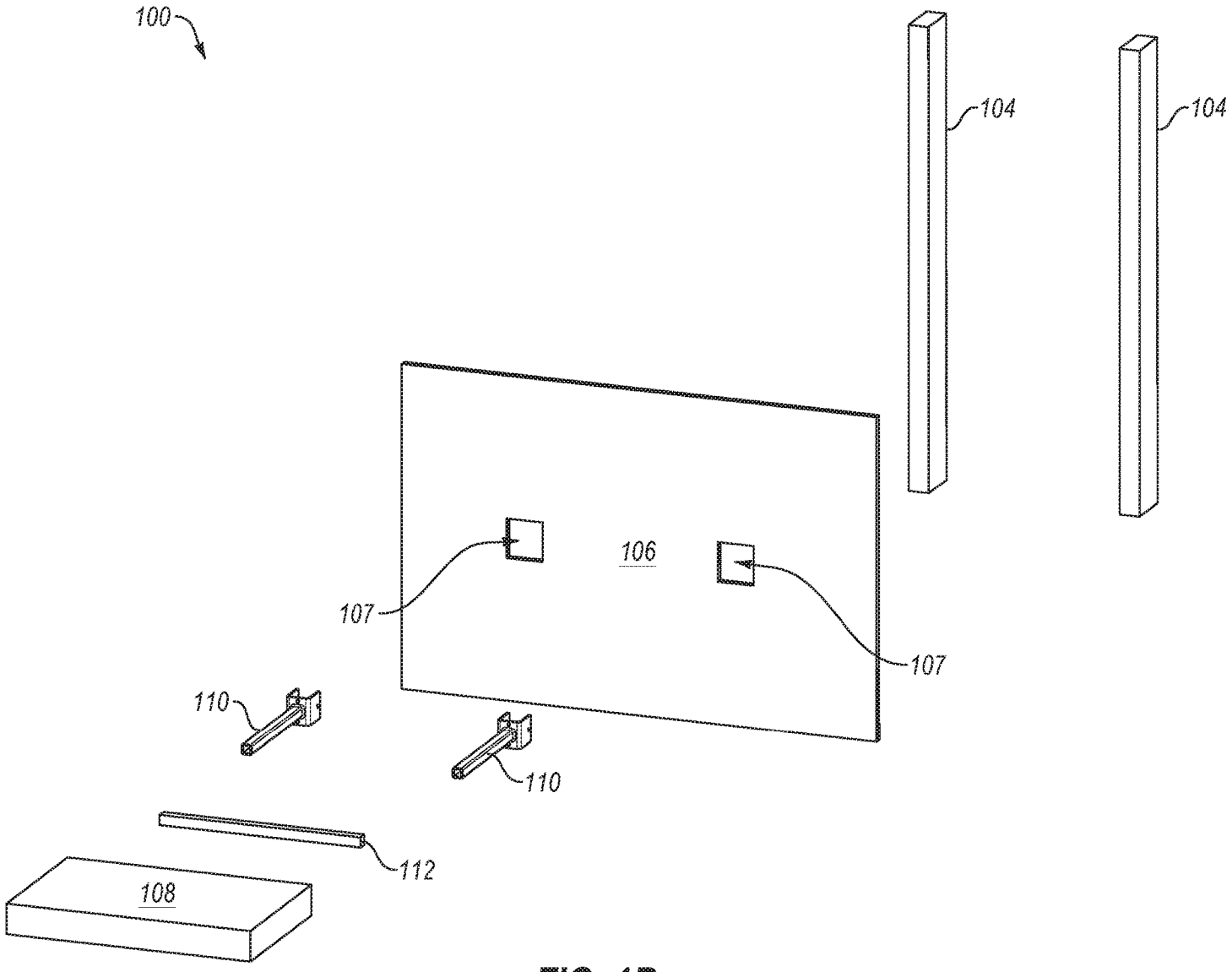
FIG. 1B illustrates a front exploded view of the environment of FIG. 1A.
Figure 1C:
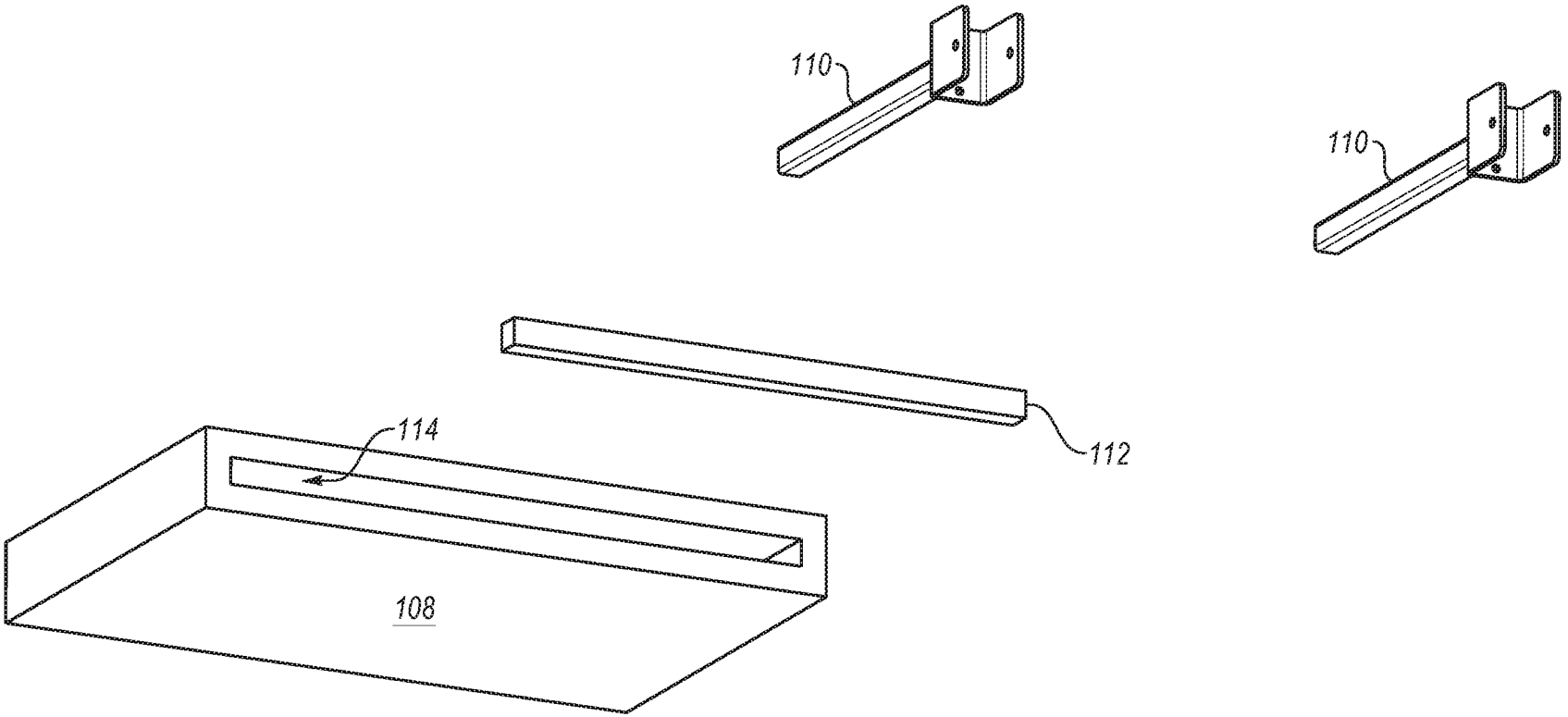
FIG. 1C illustrates a rear exploded view of a portion of the environment of FIG. 1A.

FIGS. 1A-1C illustrate an example environment 100 in which some embodiments may be practiced. FIG. 1A illustrates a perspective view of the environment 100. FIG. 1B illustrates a front exploded view of the environment 100. FIG. 1C illustrates a rear exploded view of a portion of the environment 100.

The environment 100 may include a wall 102, which may include a conventional wall generally associated with conventional buildings such as residential, commercial, and industrial buildings. The wall 102 may generally include support members 104 and wallboard 106. Optionally, the wallboard 106 may be omitted. The wallboard 106 and the support members 104 are shown in FIGS. 1A-1B as being partially cut away for clarity. The support members 104 may include wood studs, such as two-by-four boards and the like. Alternately or additionally, the support members 104 may include metal studs, such as steel C studs and the like. Alternately or additionally, the support members 104 may include other materials such as plastic, other dimensions, and other configurations. The wallboard 106 may include any suitable wall sheathing, including drywall, cement board, lath and plaster, and the like. Additionally, the wallboard 106 may be further covered with tile, siding such as shiplap, and the like.

The environment 100 may further include a shelf 108 and brackets 110. In some embodiments, the shelf 108 may be 2.5 inches tall, although shelves having other heights may be used. FIGS. 1B-1C illustrate two brackets 110, although fewer brackets 110 (e.g., a single w bracket 110) or more than two brackets 110 may be used. Employing a relatively higher number of brackets 110 may increase a relative load that may be held by the shelf 108 when installed.

In some embodiments, the shelf 108 may cover the brackets 110 when the shelf 108 is installed on the brackets 110 such that the brackets 110 are hidden from view, as may be seen in FIG. 1A. Accordingly, for example, the brackets 110 may be less than 2.5 inches tall when used with a 2.5-inch tall shelf 108. Although embodiments are described herein in the context of supporting the shelf 108, the brackets 110 may be employed to secure other objects to a wall, as noted herein.

As may be seen in FIG. 1B, the wallboard 106 may define holes 107 through which the brackets 110 may extend. Thus, for example, the brackets 110 may be affixed directly to the support members 104 and not to the wallboard 106. Such a direct attachment may improve a strength of the connection between the brackets 110 and the wall 102 relative to a conventional bracket. For instance, a conventional bracket may be located on the wallboard 106 and fasteners may be driven through the wallboard 106 and into the support members 104. Thus, for example, a fastener may hold a conventional bracket against the wallboard 106 and not against the support members 104 directly. As a result, a fastener, which may have a relatively small cross-section, may bridge the distance between the conventional bracket and the support members 104 with the wallboard 106 providing minimal additional support. Floating shelves that rely on conventional brackets may create significant forces against the wallboard 106 and/or the fasteners. Accordingly, for example, conventional brackets may have an increased chance of damaging the wallboard 106 and/or the fasteners when subjected to a relatively significant load. For instance, the wallboard 106 may be compressed or otherwise damaged in response to the conventional shelf being overloaded, which may cause the conventional shelf to slant and/or to feel loose when unloaded. As the brackets 110 may attach directly to the support members 104, which are generally more resistant to damage than the wallboard 106, it may promote a relatively stronger shelf 108 connection that is relatively less likely to be damaged than a conventional shelf under an equivalent load.

In some wall 102 configurations, the support members 104 may include metal studs, such as steel C studs. In such configurations, the connection between a fastener of a conventional bracket and the metal stud may be relatively weaker than a fastener and a wood stud, as the metal studs commonly include hollow interiors. The brackets 110 may facilitate a configuration that reduces or eliminates the weakness of the connection to the metal stud relative to the wood stud, as is described in more detail herein.

In some embodiments, the shelf 108 may include at least one opening 114 (shown at FIG. 1C) sized and shaped to receive a portion of the brackets 110. As illustrated in FIG. 1C, the shelf 108 may include one opening 114 that extends from one bracket 110 to another bracket 110. In some configurations, the shelf 108 may include an individual opening 114 for each of the brackets 110.

In some embodiments, an optional cleat 112 sized and shaped to fit within a portion of the opening 114 may be secured to the wall such that the cleat 112 fits within the opening 114 when the shelf 108 is positioned on the brackets 110. In some embodiments, the cleat 112 may include a strip of wood, plastic, and/or metal. The cleat 112 may discourage the shelf 108 from bowing between the brackets 110. Alternately or additionally, the shelf 108 may be secured to the cleat 112 via adhesive and/or fasteners. For example, fasteners such as screws or nails may be driven though the shelf 108 and into the cleat 112.

In some embodiments, the shelf 108 may be secured to the wall 102 at least in part by an adhesive located at an interface 116 of the wallboard 106 and the shelf 108. The adhesive may encourage the shelf 108 to remain positioned on a shelf-holding protrusion of the brackets 110. In some embodiments, the adhesive may include a silicon adhesive.

Alternately or additionally, a fastener may be positioned through a portion of the shelf 108 and may abut or be positioned at least partially through the brackets 110. For example, in some embodiments, one or more bolts or screws may be driven through a portion of the shelf 108, such as the underside of the shelf 108, and against or into the bracket 110. Such fasteners may encourage the shelf 108 to remain positioned on the brackets.

Figure 2A:
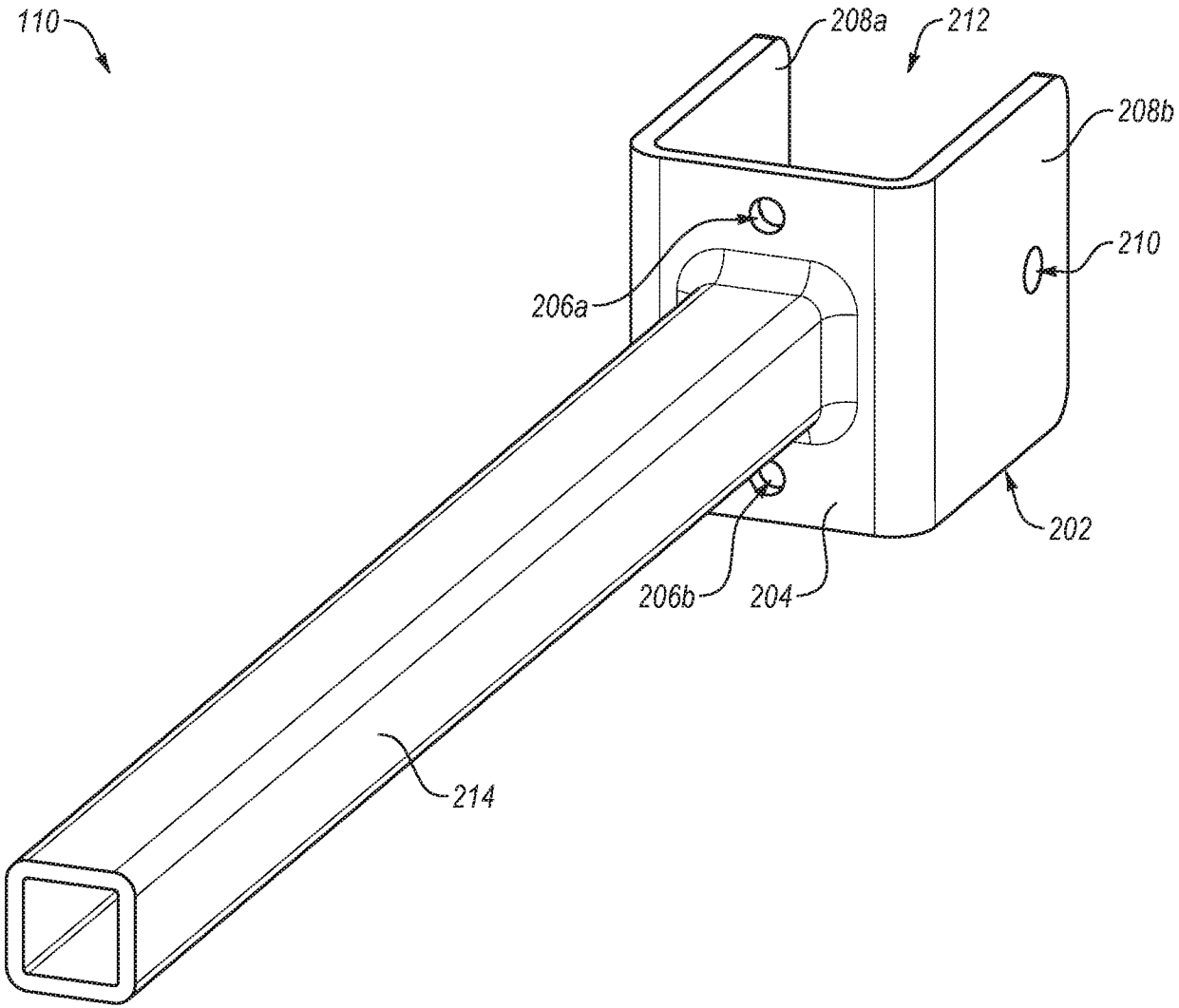
FIG. 2A illustrates an example support bracket.
Figure 2B:
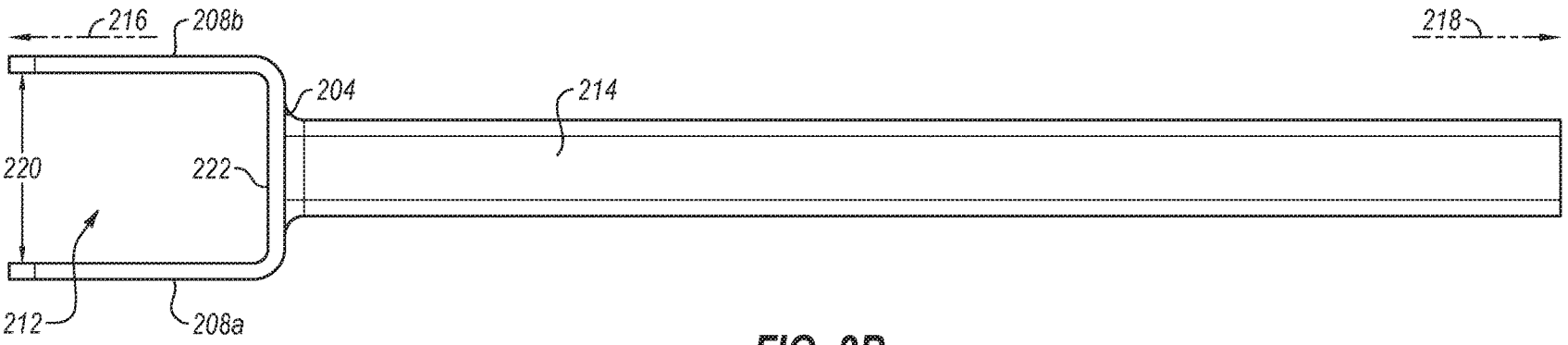
FIG. 2B illustrates a top view of the example support bracket of FIG. 2A.
Figure 2C:
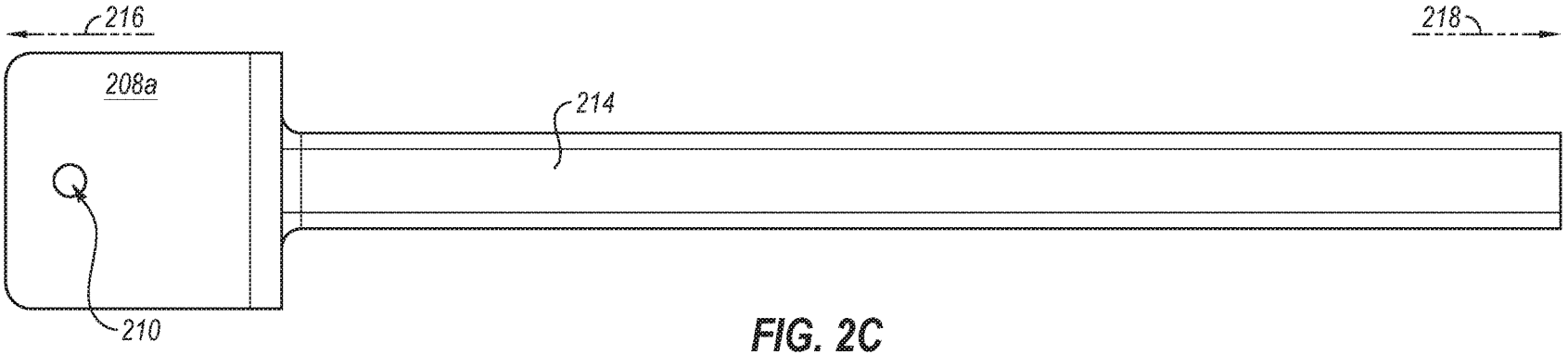
FIG. 2C illustrates a side view of the example support bracket of FIG. 2A.
Figure 2D:
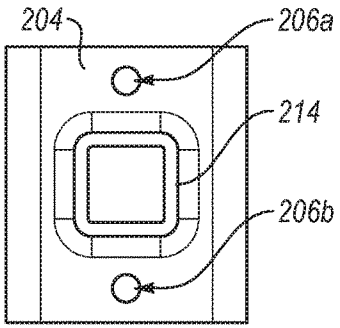
FIG. 2D illustrates a front view of the example support bracket of FIG. 2A.

FIGS. 2A-2D illustrate an example bracket 110. FIG. 2A illustrates a perspective view of the bracket 110. FIG. 2B illustrates a top view of the bracket 110. FIG. 2C illustrates a side view of the bracket 110. FIG. 2D illustrates a front view of the bracket 110. The bracket 110 includes a brace section 202. The brace section 202 may include a base 204, as well as an arm 208*a* and an arm 208*b* (collectively, "arms 208"). The base 204 and/or the arms 208 may comprise rectangular plates. The bracket 110 further includes a protrusion 214 positioned on the base 204.

The brace section 202 may facilitate mechanical attachment of the bracket 110 directly to a support member of a wall, such as the support members 104 of the wall 102 of FIGS. 1A-1B. The brace section 202 may include the base 204. When the bracket 110 is mechanically attached to a support member of a wall, the base 204 may be positioned substantially in-plane with a wallboard, such as the wallboard 106 of FIGS. 1A-1B, of the wall.

The base 204 may be configured to provide a relatively strong support for a cantilever connection. In some embodiments, the base 204 may be formed from ⅛-inch steel. Alternatively, the base 204 may be formed from a different material and/or may have a different thickness.

The base 204 may define a hole 206*a* and may optionally define an additional hole 206*b* (collectively, "holes 206"). The holes 206 may be sized and shaped to receive a fastener. For instance, the holes 206 may be round and larger than a width of a shank of a screw, bolt, or some other fastener suitable to secure the bracket 110 to the support member. By way of example, the holes 206 may include a ¼-inch diameter hole, a ⅜-inch diameter hole, or the like. In some embodiments, the base 204 may define a single hole 206*a* and the bracket 110 may be oriented such that the hole 206*a* is located above the protrusion 214. The holes 206 may be centered horizontally relative to the base 204. Alternately or additionally, the base 204 may define holes 206 in other positions. For instance, the base 204 may alternately or additionally define a pair of holes offset from a vertical midline of the base 204. In some configurations, such a pair of holes may be positioned above the protrusion 214.

The brace section 202 includes the arms 208. In some embodiments, the arms 208 may be formed from ⅛-inch steel. Alternately, the arms 208 may be formed from a different material and/or may have a different thickness. The arms 208 may be located at opposite edges of the base 204 and may extend from the base 204 in substantially a same direction. For instance, when the single bracket 110 is attached to a support member, the arms 208 may extend in the direction of the support members relative to the wallboard of the wall. Put another way, the arms 208 may extend in a rearward direction 216 as indicated at FIGS. 2B-2C. In some embodiments, the base 204 and the arms 208 may be formed from a single piece of metal via forging, casting, stamping, or the like. The arms 208 may generally improve a stability of the bracket 110 relative to the support member.

The positions of the arms 208 and the base 204 may form a channel 212. The channel 212 may be sized and shaped to fit over standard sizes of support members. For instance, a width 220, as shown at FIG. 2B, of the channel 212 may be a nominal 1.5 inches, such that common support member sizes may fit within the channel 212. For instance, the channel 212 may have a nominal width 220 suitable to receive a width of a two-by-four wood board or a metal C stud. Alternatively, the channel 212 may have a nominal width 220 suitable to receive differently-sized support members.

In some embodiments, each of the arms 208 may define a hole 210. The holes 210 may be sized and shaped to receive a fastener. For instance, the holes 210 may be round and larger than a width of a shank of a screw, bolt, or some other fastener suitable to secure the bracket 110 to the support member. By way of example, the holes 210 may include a ¼-inch diameter hole, a ⅜-inch diameter hole, or the like. In some configurations, the holes 210 may be coaxially aligned. Fasteners positioned through the holes 210 and into the support member may generally increase the strength of the connection between the bracket 110 and the support member. In some embodiments, a fastener through the holes 210 may be omitted. For instance, to install the bracket 110 to an existing wall, which may be described as an old work installation, a fastener may not be introduced through the holes 210, as described herein.

In some embodiments, a spike may be included on a back wall 222 (shown at FIG. 2B) of the base 204. The spike may be approximately one inch long and may be suitably narrow to drive into a support member. Such a spike may assist with installation of the bracket 110. For instance, the bracket 110 may be positioned on a support member and the spike driven into the support member to hold the bracket 110 in position while the fasteners are driven into the support member via the holes 206 and/or the holes 210.

Figure 3:
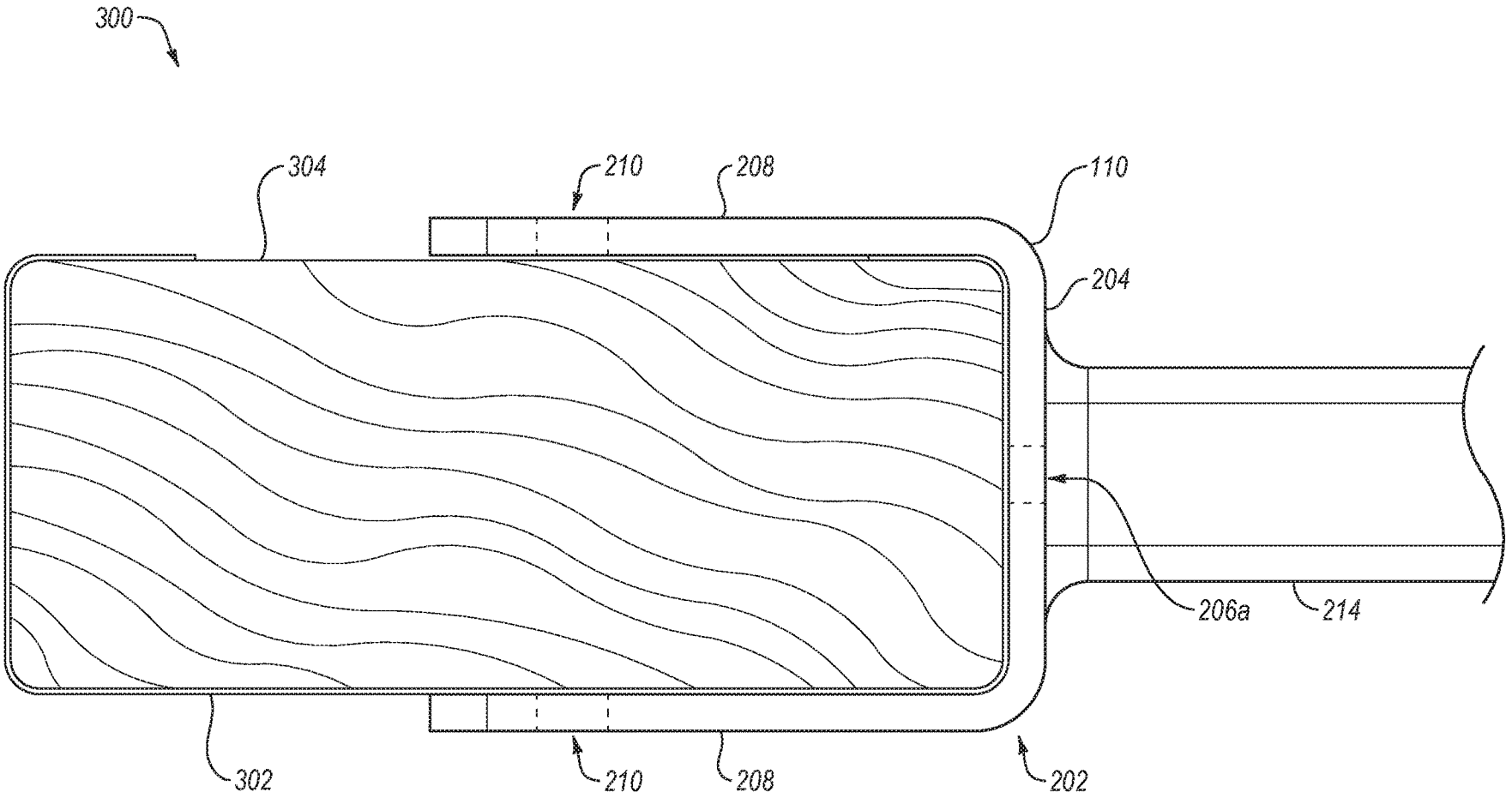
FIG. 3 illustrates a top view of an example environment in which some embodiments may be practiced.

FIG. 3 illustrates a top view of another example environment 300 in which some embodiments may be practiced. The environment 300 may include a metal stud 302. The metal stud 302 may include a metal C stud and may generally correspond to the support member 104 of FIGS. 1A-1B. As noted herein, securing the bracket 110 to a metal stud alone may create a relatively weaker connection and support for a shelf when compared to securing the bracket 110 to a wood stud.

The bracket 110 may facilitate strengthening the connection and the support of metal studs. In some embodiments, a wood stud 304 may be introduced to the hollow interior of the metal stud 302. In some configurations, the wood stud 304 may be limited in length such that the location of the wood stud 304 is limited to a location near a mounting position of the bracket 110. Alternatively, the wood stud 304 may be located through a significant length of the metal stud 302.

One or more fasteners such as screws or bolts may be introduced through the holes 210 of the bracket 110, through the metal stud 302, and into or through the wood stud 304. For example, in some embodiments, a bolt may be positioned through the holes 210, the metal stud 302, and the wood stud 304 such that the bolt extends through both holes 210. Alternatively, screws may extend through each of the holes 210, through the metal stud 302 on at least one side of the metal stud 302, and into the wood stud 304. The introduction of the wood stud to the metal stud 302 and the bracket 110 assembly may significantly improve the strength of the bracket 110 and the metal stud 302 connection, as well as a feeling of sturdiness for the bracket 110 and associated shelf relative to a connection with a metal bracket 302 that omits the wood stud 304.

Returning to FIGS. 2A-2D, the bracket 110 may include a protrusion 214. The protrusion 214 may be located on the base 204 of the brace section 202. When the bracket 110 is attached to a support member of a wall, the protrusion 214 may extend away from the wall. Put another way, the protrusion 214 may extend in a forward direction 218 as indicated at FIGS. 2B-2C. The forward direction 218 may be substantially opposite the backward direction 216.

In some embodiments, the protrusion 214 may be welded to the brace section 202. Alternately or additionally, the protrusion 214 may be cast, forged, extruded, stamped, fastened, or the like with the brace section 202. The protrusion 214 may be hollow to facilitate drilling into the protrusion 214 and to improve a strength to mass ration of the protrusion 214.

The protrusion 214 may have any suitable length. By way of example, the protrusion 214 may be 10 inches long, 20 inches long, or 27 inches long. In some embodiments, the protrusion 214 may be ½-inches tall and ½-inches wide. Alternately, the protrusion 214 may be ¾-inches tall and ¾-inches wide, or may have other lengths, widths, and/or heights.

In some embodiments, the protrusion 214 may have a non-square cross-section shape. For example, the protrusion 214 may be wider than it is tall to accommodate shelf sizes that employ a single bracket 110. Alternately or additionally, the protrusion 214 may exhibit a variety of other shapes, such as hook shapes; rail shapes, which may facilitate the hanging of relatively shallow objects such as art, mirrors, and the like; ring and loop shapes; and the like.

Figure 4:
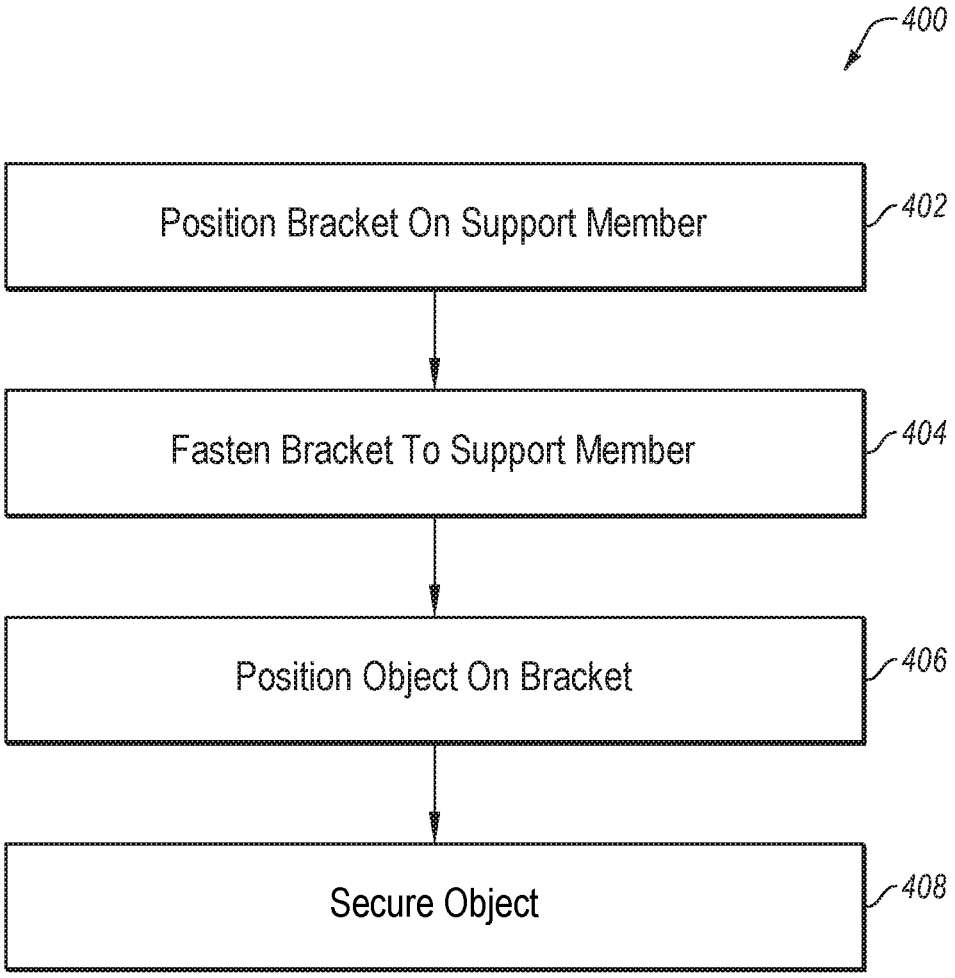
FIG. 4 is a flowchart of an example method of installing a floating shelf.

FIG. 4 is a flowchart illustrating a method 400 of installing an object on a wall. In some embodiments, the object may include a shelf generally corresponding to the shelf 108 of the preceding description. The method may begin at block 402 by positioning a bracket on a support member of the wall. The bracket, the support member, and the wall may generally correspond, respectively, to the bracket 110, support member 104, and the wall 102 of the preceding description. The bracket may be positioned on the wall such that the support member is located within a channel of the bracket. The channel may generally correspond to the channel 212 of the preceding description. The channel may be formed by a base of the bracket and two arms of the bracket extending from the base in a first direction. The base, the two arms, and the first direction may generally correspond, respectively, to the base 204, the arms 208, and the rearward direction 216 of the preceding description.

The method 400 may continue at block 404 by fastening the bracket to the support member, which may include extending a fastener through a hole defined by the base of the bracket and into the support member. The hole defined by the base of the bracket may generally correspond to the holes 206 of the preceding description.

The method 400 may continue at block 406 by positioning the object onto a protrusion of the bracket. The protrusion may extend from the base of the bracket in a second direction. The protrusion of the bracket and the second direction may generally correspond, respectively, to the protrusion 214 and the frontward direction 218 of the preceding description.

The method 400 may continue at block 408 by securing the object. The object may be secured to the wall via adhesive applied at an interface that may generally correspond to the interface 116 of the preceding description. Alternately or additionally, the object may be secured to the bracket by driving a fastener through the object and into the protrusion of the bracket.

In some embodiments, the method 400 may further include securing a cleat to the wall. The cleat may generally correspond to the cleat 112 of the preceding description. Securing the object to the wall may include attaching the object to the cleat. For instance, fasteners such as screws or nails may be driven though the object and into the cleat.

Optionally, the method 400 may further include cutting a hole in a wallboard of the wall. The wallboard and its associated hole may generally correspond, respectively, to the wallboard 106 and the hole 107 of the preceding description. Additionally, the method 400 may include installing the wallboard to the support member such that the bracket is located within the hole of the wallboard. For example, the bracket may be installed on the support member before the wallboard is installed on the support member. Such an installation may be considered a new work installation of the bracket. Alternatively, the wallboard may be secured to the support member and positioning the bracket on the support member may include positioning the bracket within the hole of the wallboard. For example, a previously installed wallboard may be cut adjacent to a support member to provide access to the support member such that the bracket may be installed. Such an installation may be considered an old work installation of the bracket.

The support member may include a metal stud having a hollow interior. In some instances, the method 400 may include inserting a wood stud into the hollow interior of the metal stud such that the metal stud and the wood stud are located within the channel of the bracket. The metal stud and the wood stud may generally correspond, respectively, to the metal stud 302 and the wood stud 304 of the preceding description. Optionally, the method 400 may further include extending a second fastener through a hole defined by one of the arms of the bracket. The hole defined by one of the arms of the bracket may generally correspond to the hole 210 of the preceding description.

What is claimed is:

1. A support bracket for supporting a shelf comprising:
a brace section including:
a base defining a first opening and a second opening;
a first arm extending from the base in a first direction; and
a second arm extending from the base substantially in the first direction; and
a protrusion extending from the base of the brace section in a second direction, wherein the second direction is substantially opposite the first direction, and wherein the protrusion has a substantially square cross-section;
wherein the protrusion is centered vertically on the base with the first opening and the second opening positioned on opposite sides of the protrusion such that the first opening, the second opening, and the protrusion are vertically centered directly on a vertical midline of the base, and the support bracket is symmetrical relative to both a horizontal midline and a vertical midline of the support bracket, wherein the protrusion is configured to be inserted in an opening of the shelf.

2. The support bracket of claim 1, wherein a distance between the first arm and the second arm is approximately 1.5 inches.

3. The support bracket of claim 1, wherein:
the first arm defines a third opening; and
the second arm defines a fourth opening.

4. The support bracket of claim 3, wherein:
the third opening is circular;
the fourth opening is circular; and
the third opening and the fourth opening are substantially coaxially aligned.

5. The support bracket of claim 1, wherein the base includes a first rectangular plate.

6. The support bracket of claim 5, wherein:
the first arm includes a second rectangular plate; and
the second arm includes a third rectangular plate.

7. The support bracket of claim 5, wherein:
the first arm is located at a first edge of the base; and
the second arm is located at a second edge of the base, the first edge and the second edge located at opposite ends of the base.

8. The support bracket of claim 1, wherein the protrusion comprises a hook.

9. The support bracket of claim 1, wherein the protrusion is hollow.

10. The support bracket of claim 1, further comprising a spike located on the base and extending in the first direction.

* * * * *